US006526854B1

(12) United States Patent
Kytönen et al.

(10) Patent No.: US 6,526,854 B1
(45) Date of Patent: Mar. 4, 2003

(54) METHOD FOR CUTTING A WEB FEEDING TAIL AND A CORRESPONDING CUTTING DEVICE

(75) Inventors: Paul I Kytönen, Tuusula (FI); Pekka Koivukunnas, Järvenpää (FI); Juha Lipponen, Palokka (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/890,183

(22) PCT Filed: Feb. 1, 2000

(86) PCT No.: PCT/FI00/00065

§ 371 (c)(1),
(2), (4) Date: Jul. 26, 2001

(87) PCT Pub. No.: WO00/46444

PCT Pub. Date: Aug. 10, 2000

(30) Foreign Application Priority Data

Feb. 1, 1999 (FI) ..... 990174

(51) Int. Cl.[7] ..... B26D 7/06
(52) U.S. Cl. ..... 83/24; 83/24

(58) Field of Search ..... 83/24, 105, 13, 83/23, 27, 99, 102, 175

(56) References Cited

U.S. PATENT DOCUMENTS

| | | | |
|---|---|---|---|
| 4,007,656 A | 2/1977 | Poloni | 83/175 |
| 4,613,321 A | 9/1986 | Alfredo | 493/342 |
| 6,038,951 A | 3/2000 | Kesten et al. | 83/105 |
| 6,070,510 A | 6/2000 | Erdody et al. | 83/37 |

*Primary Examiner*—Paul T. Sewell
*Assistant Examiner*—M. Chambers
(74) *Attorney, Agent, or Firm*—Fildes & Outland, P.C.

(57) ABSTRACT

The invention relates to a method for cutting a web feeding tail and a corresponding cutting device. In the method the web feeding tail is detached from a roll and tension ed for cutting. The web feeding tail is cut by the blade of a cutting device, without a counter blade, and the cut web feeding tail is guided forwards in the desired direction to a next web feeding device. The cutting device is located on the opposite side of the web feeding tail to the aforesaid following web feeding device. The web feeding tail is cut by the blade over the entire width of the web feeding tail. At the same time, the cut web feeding tail is guided in a single layer from the blade to the aforesaid web feeding device.

7 Claims, 6 Drawing Sheets

METHOD FOR CUTTING A WEB FEEDING TAIL AND A CORRESPONDING CUTTING DEVICE

TECHNICAL FIELD

The present invention relates to a method for cutting a web feeding tail, in which method the web feeding tail is detached from the roll, the web feeding tail is guided against the cutting device, the web feeding tail is tension ed for cutting, the web feeding tail is cut with a single work stroke of the blade of the cutting device, without a counter-blade, and the cut web feeding tail is guided forwards from the cutting device, in the desired direction to the following web feeding device.

The invention also relates to a corresponding cutting device.

BACKGROUND OF THE INVENTION

At certain points, the transfer of the web from one section of a paper machine to the next is started using a narrow web feeding tail. The web feeding tail, which generally has a width of less than 500 mm, is cut from the edge of the full-width paper web. After web feeding, once the web feeding tail is moving over the correct route, the web feeding tail is finally broadened to the full width of the web.

Usually, the web feeding tail is cut before beginning the actual feeding of the web. In known devices, various jets of air are used both to cut the web feeding tail and to direct it. Finish patent number 82101 discloses a cutting device, in which there is also a blade without a counter-blade for cutting the web feeding tail. In a cutting device according to this patent, two blasts of air, by means of which the web feeding tail can be guided in the desired direction. In the case of thinner grades of paper, the web feeding tail breaks already from the effect of the second blast of air. For thicker paper grades, the device also has a blade arranged between the blower pipes, which rotates to cut through the web feeding tail, without a counter-blade.

When cutting using an air blast, the exact point and time of the cut in the web feeding tail are imprecise. In addition, the cut surface becomes uneven, which makes it difficult to guide the web feeding tail. The ragged end may also result in the unintentional breaking or crumpling of the web feeding tail at a later stage. When applying the device of the aforesaid patent, a fold also forms in the web feeding tail, which it may not be possible to straighten in time. The web feeding tail may then fold twice, in which case the tail after the fold will interfere greatly with web feeding. In addition, the rotating blade creates a lateral movement in the web feeding tail, which further interferes with the control of the end. Even if the web feeding tail is relatively narrow, it is still able to move forward during cutting. Thus, the cut surface acquires a slant. This problem appears especially in modern, high-speed machines.

The typical speed of the web feeding tail in web feeding is 20–30 m/s, in some cases, as much as 33–38 m/s. At the same time, it is difficult to regulate the forces of the air blasts of the cutting device, so that the cutting of the web feeding tail and even the success of the web feeding itself are uncertain. This increases the total time of the web feeding and the amount of waste paper. The installation of the cutting device disclosed also requires a great deal of space.

SUMMARY OF THE INVENTION

The invention is intended to create a method of cutting a web feeding tail, by means of which the formation of tails and other folds in the web feeding tail can be avoided, and which is simpler and more reliable than previously. The invention is also intended to create a web feeding tail cutting device, which is fast, precise, and reliable, and which can be applied to all grades of paper. A method for cutting a web feeding tail, in which method the web feeding tail is detached from the roll, the web feeding tail is guided against the cutting device, the web feeding tail is tension ed for cutting, the web feeding tail is cut with a single working stroke of the blade of the cutting device, without a counter-blade, and the cut web feeding tail is guided forwards, from the cutting device, in the desired direction to the next web feeding device, wherein the cutting device is located on the opposite side of the web feeding tail to the aforesaid following web feeding device, the web feeding tail is tension ed against a guide surface arranged in the cutting device, at the end of which guide surface, in the direction of travel of the web feeding tail, there is an edge, the blade is arranged essentially after the edge, in the aforesaid direction of travel, before cutting, the aforesaid following web feeding device is moved essentially to the location of the blade and into an essentially transverse position in relation to the web feeding tail, the web feeding tail is cut with a single rapid stroke of the blade over the entire width of the web feeding tail, when, at the same time, the cut end of the web feeding tail is guided from the blade to the aforesaid following web feeding device.

After the cutting of the web feeding tail, the blade may be left at the end of its work stroke to form a protrusion to guide the cut end of the web feeding tail to the following web feeding device. After the work stroke of the blade, a blast of air may be directed from the cutting device in the desired direction.

A cutting device for a web feeding tail, which is intended to cut the web feeding tail and then to guide the cut web feeding tail in the desired direction, and which cutting device includes devices for detaching the web feeding tail from the roll, first web feeding devices for guiding the web feeding tail against the cutting device and for tensioning the web feeding tail for cutting, a blade connected to an operating device for cutting the web feeding tail with a single working stroke, without a counter-blade, and second web feeding devices for guiding the cut web feeding tail guided forwards, from the cutting device, in the desired direction, wherein the second web feeding device includes a guide plate, on the opposite side of the web feeding tail to which the cutting device is arranged, the guide plate is arranged to be moved essentially to the location of the blade at a distance from the web feeding tail, so that the web feeding tail is arranged to travel between the cutting device and the front of the guide plate, the aforesaid first web feeding devices are arranged to form a guide surface, against which the web feeding tail is arranged to be tension ed for cutting, an edge, which ends in the direction of travel of the web feeding tail, immediately after which the blade is located, and the work stroke path of the blade, which is arranged to operate in pulses, is arranged essentially according to the desired direction of the web feeding tail.

An auxiliary blast of air, may be arranged before the blade essentially parallel to the guide plate. The guide plate may be supported rotatably on an articulated joint, in such a way that the front of the guide plate is close to the cutting device.

In the operating position, the distance of the front of the guide plate from the cutting device is 20–100 mm and preferably 45–75 mm.

The devices for detaching the web feeding tail from the roll, and the cutting device may be arranged as a single entity, which entity is fitted rotatably in relation to bearer axles.

The first web feeding devices may include a blower plate, between the parts of which the blade is arranged to cut the web feeding tail. The part of the blower plate after the blade may be supported on an articulated joint, so that the aforesaid part can be turned from the rest position into the operating position.

In the method according to the invention, the blade of the cutting device is used to guide the web feeding tail, as well as to cut it. In addition, the blade is arranged to cut the web feeding tail simultaneously over its entire width, so that the cut is rapid and the cut even is even. The tail is guided immediately from the cutting device to the following web feeding device. Thus, the web feeding tail being guided remains only a single thickness and detrimental folds and tails are not formed. In addition, during cutting the web feeding tail is always under control, so that web feeding seldom fails. There are also clear stages in web feeding and the cutting of the web feeding tail, which increases the likelihood of success. In addition, the device requires little installation space and contains few moving parts.

BRIEF DESCRIPTION OF THE DRAWINGS

In the following, the invention is described in detail with reference to the accompanying drawings showing one embodiment of the invention, in which.

DETAILED DESCRIPTION OF THE INVENTION

Figure 1:
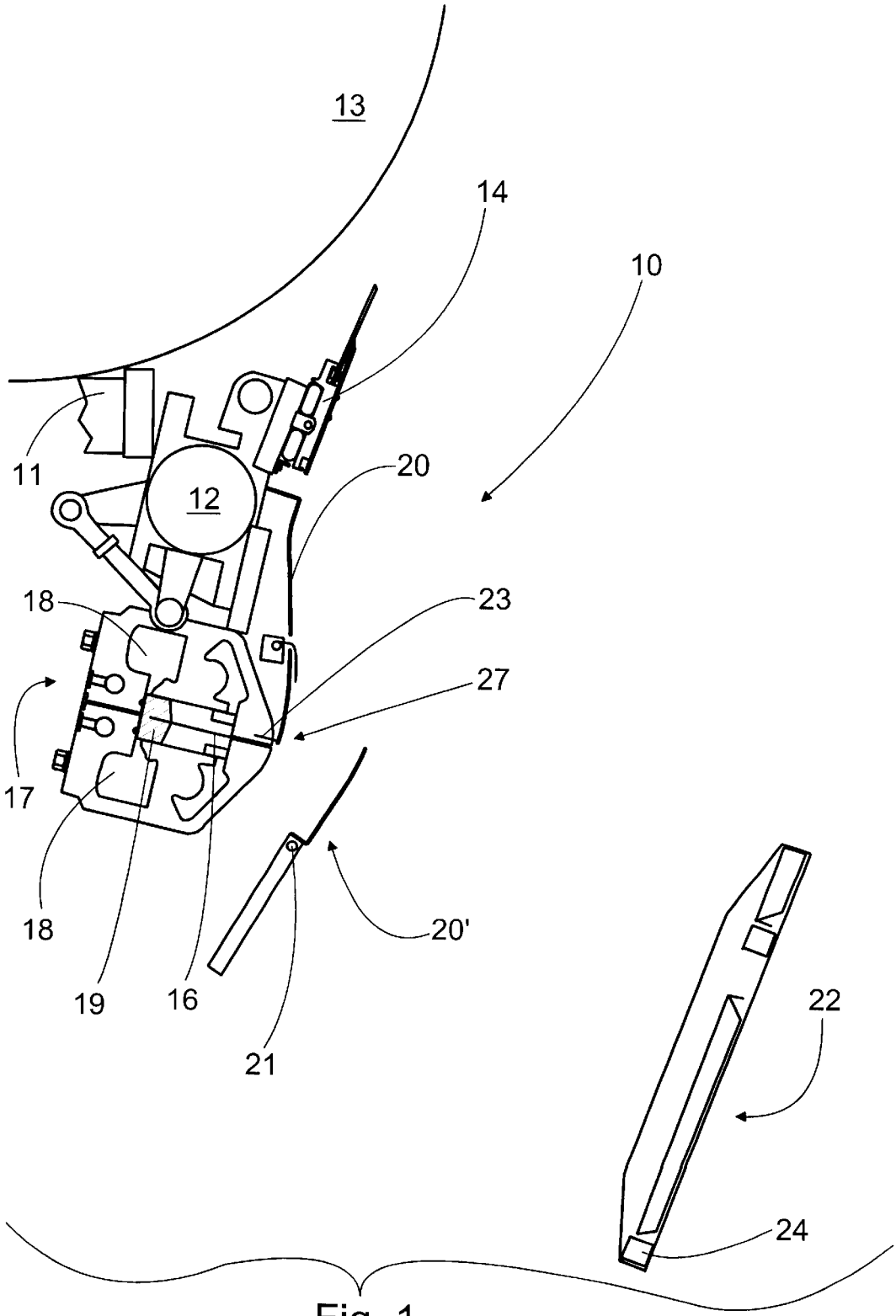
FIG. 1 shows a side view of a cutting device according to the invention, applied in connection with a roll.

FIG. 1 shows a cutting device 10 according to the invention, turned to its rest position. Cutting device 10 is attached to the frame construction 11 of the paper machine and can be turned in relation to the bearer axle 12 by means of an operating device. If necessary, the entire cutting device can be removed from the vicinity of roll 13 (not shown). The cutting device 10 also permanently includes a doctor 14, which is used to remove the web feeding tail from roll 13. In this case, doctor 14 is hose-loaded and turns with the cutting device 10 in the manner shown. Thanks to this, the construction of the cutting device is very simple and the device is brought to the operating position by means of a single operating device. In addition, the cutting device requires little installation and operating space.

In the example, the operating device 17 moving cutting blade 16 corresponds in principle to the device disclosed in Finish patent application number 972329. In this case, operating device 17 is pneumatically operated, but other kinds of solution are also possible. Other power sources include a spring, a gas or explosive charge, and a separate gas cartridge. Compressed air is, however, the preferred alternative, because it is readily available, it does not produce dirt, and it is easy to control. Before cutting, compressed-air chambers 18 are charged, with piston 19 in the retracted position. At the moment of cutting, the pressure released from chambers 18 pushes piston 19 and the attached blade 16 into motion. The stroke of blade 16 is short but extremely fast. Before the next cut, chambers 18 are recharged.

Figure 2:
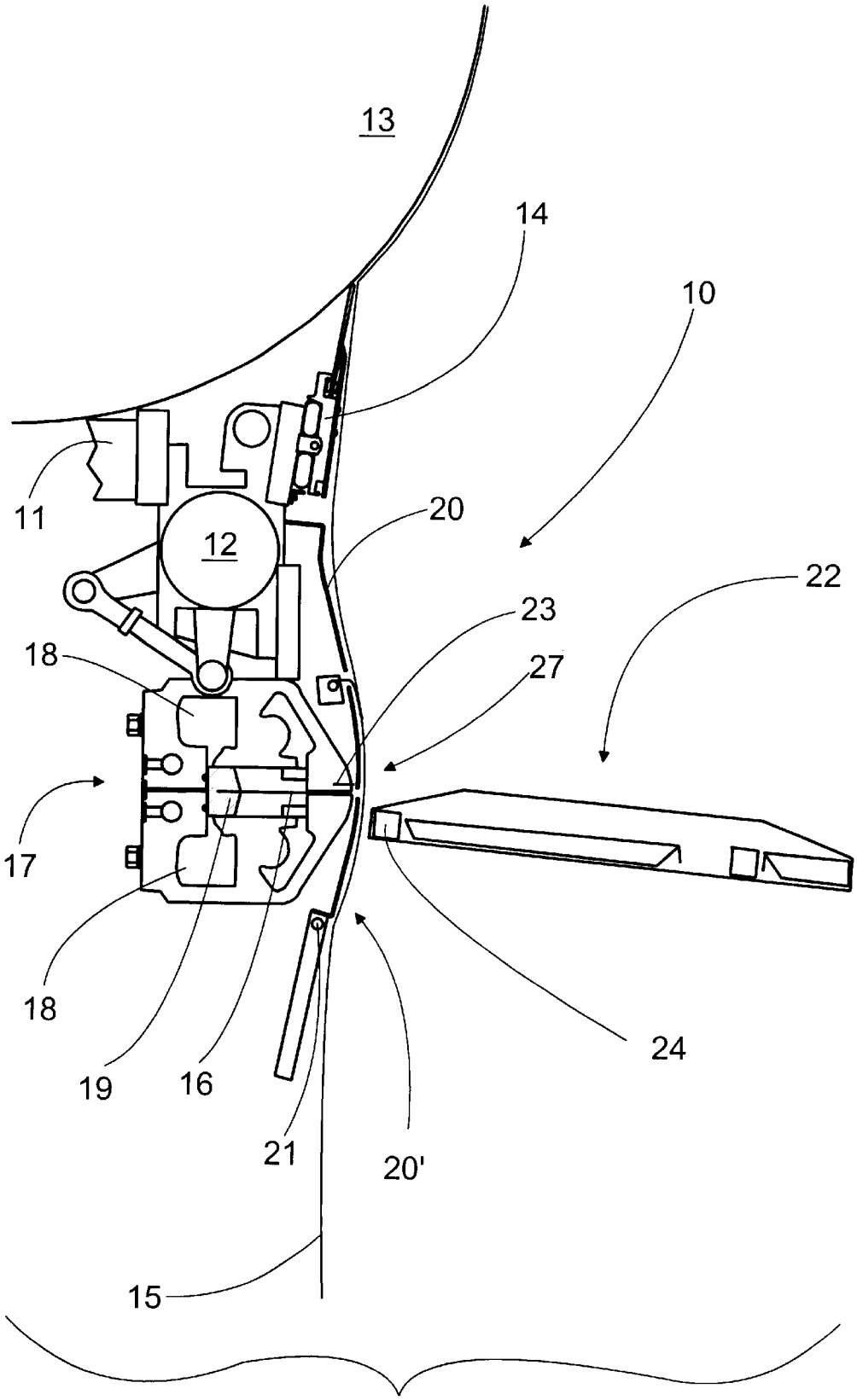
FIG. 2 shows the start of the operation of the cutting device of FIG. 1.

Cutting device 10 also includes a fixed blower plate 20, by means of which web feeding tail 15 is guided against cutting device 10. Blower plate 20 then forms a guide surface, which can also be implemented in some other way. Blower plate 20 is also used to tension web feeding tail 15 for cutting. In the remainder of the description, the web feeding tail will be simply referred to as the tail. In the embodiment, blower plate 20, which forms the guide surface, is in two parts. Blade 16 between these blower plate 20 parts is arranged to cut tail 15 (FIG. 2). In other words, blade 16 is set essentially after the edge 27 of the guide surface, in the direction of travel of tail 15. In addition, part 20' of blower plate 20 after blade 16 is supported on articulated joint 21, to turn the aforesaid part 20' from the rest position to the operating position. Thus, in the operating position, the parts of blower plate 20 determine the gap, which improved the operation of cutting device 10. The support of the latter part 20' from cutting device 10 is not shown.

Figure 3:
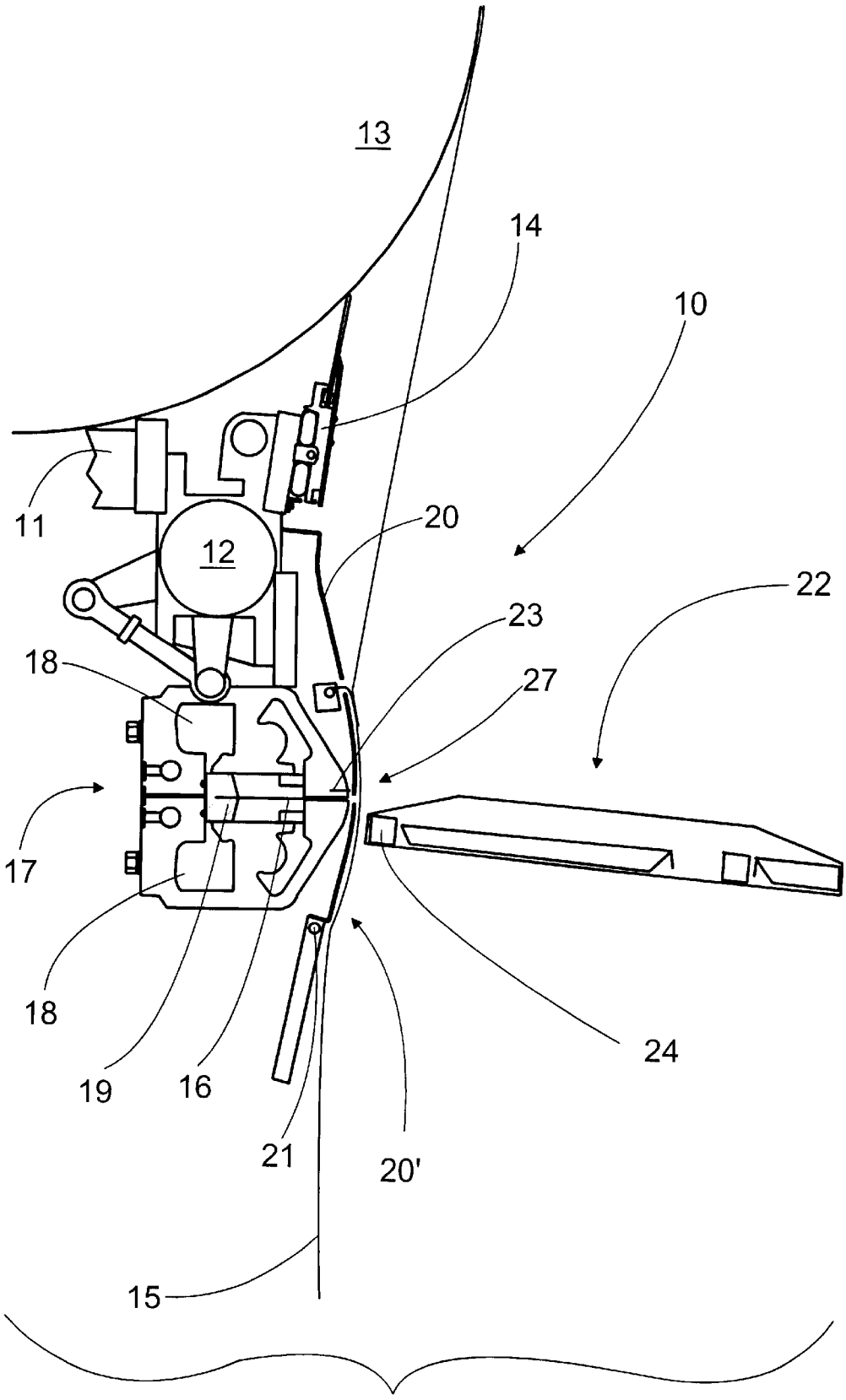
FIG. 3 shows the cutting device of FIG. 1, before cutting.

FIG. 2 shows a cutting device 10 at the start of its operation. Here, tail 15 has been brought against cutting device 10 and tension ed on both sides over blade 16 with the aid of blower plate 20. Other means of tensioning include an auxiliary nip arranged after the tensioning device, pulper suction, or a trimmings suction box. A so-called tailbelt fabric, to which the tail can be attached, for example, by means of a vacuum, can also be used for tensioning. The tail being led to the pulper can also be wet using a water jet, so that the weight of the wetted tail will tension the tail. Before cutting, tail 15 is run down to a pulper. As the tension increases, tail 15 detaches from the surface of roll 13, according to FIG. 3. Irrespective of the manner of tensioning, however, at the moment of cutting, the tail lies against the e guide surface and is tight over the blade.

According to the invention, cutting device 10 also includes a guide plate 22, which is set at a distance from tail 15 essentially at blade 16. In addition, guide plate 22 is set according to the desired web feeding direction. In this case, guide plate 22 is slightly after blade 16, in the direction of travel of tail 15. Guide plate 22 is also supported by an articulated joint in such a way that in its operating position, the front of guide e plate 22 is close to cutting device 10, as shown in FIG. 2. Thus, when cutting, blade 16 causes the end 15' of tail 15 to turn to guide plate 22, which is nearby. Instead of a rotating guide plate 22, it is also possible to use a guide plate that moves linearly, or in some other manner. Usually, however, in the operating position the distance of the front of the guide plate from the cutting device is 20–100 mm, preferably 45–75 mm.

Unlike the state of the art, cutting device 10 is arranged on the opposite side of tail 15 to guide plate 22. Thus tail 15 travels without obstruction and smoothly before cutting, between cutting device 10 and the front of guide plate 22. In addition to this, the path of blade 16 during the working stroke is arranged essentially according to the desired feeding direction of tail 15. Thus, the working stroke of blade 16 assists successful feeding.

To ensure feeding, an auxiliary air blast 23 can be arranged in cutting device 10, before blade 16, essentially parallel to guide plate 22. Auxiliary blast 23 is used to achieve the same effect on tail 15 as the impact of blade 16. There are also air nozzles in guide plate 22, when the end 15' of the cut tail 15 travels along the surface of guide plate 22, in exactly the same way as on the blower plate. In fact, the guide plate is a kind of blower plate. A suitable number of conventional web feeding devices follows guide plate 22.

Figure 4A:
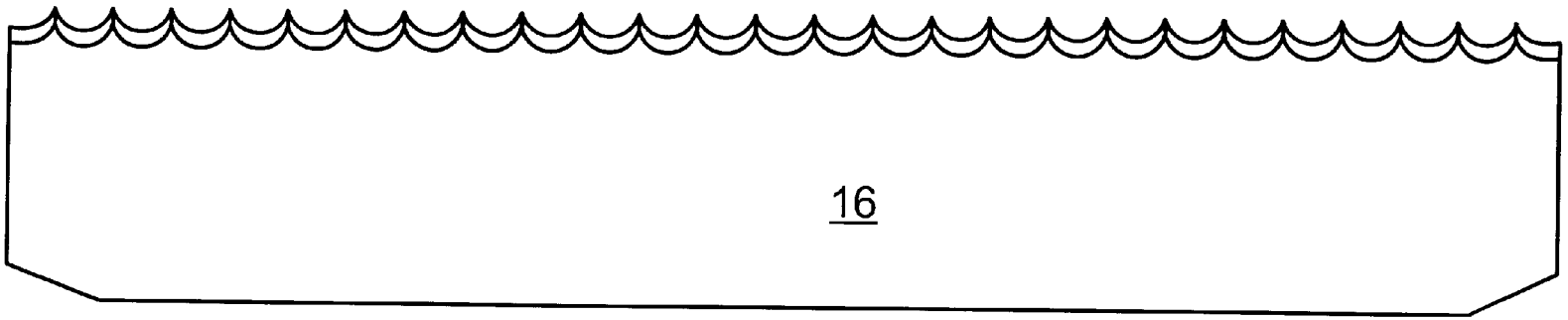
FIG. 4*a* shows one blade alternative for use in a cutting device according to the invention.
Figure 4B:
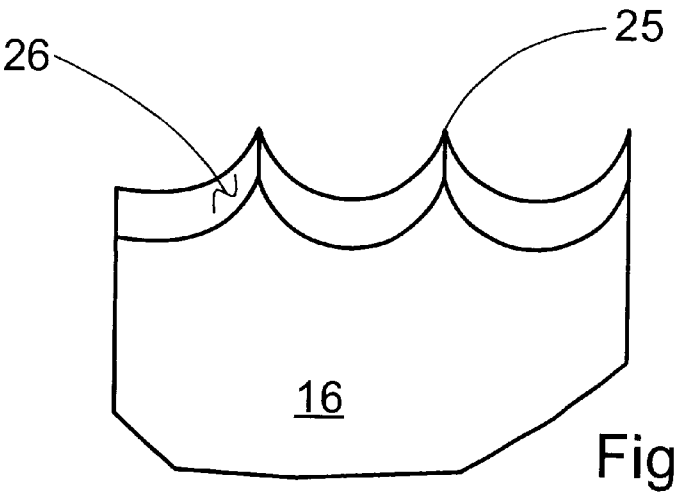
FIG. 4*b* shows a partial enlargement of the blade of FIG. 4*a,*

FIG. 4*a* shows a top view of one preferable blade model for use in a cutting device according to the invention. FIG. 4*b* shows a partial enlargement of blade 16. The spiked points 25 of blade 16 make small holes in the thin tail, along which the tail more or less separates by itself. In the case of thicker paper grades, the slanting surfaces and sharp parts 26 are able to cut the tail. The blade does not protrude to any great extent, generally 10–30 mm. Despite this, the separation of the tail is certain, when the thickness of the tail is taken into account, along with its tightness against the cutting device and its guide surface.

Figure 5A:
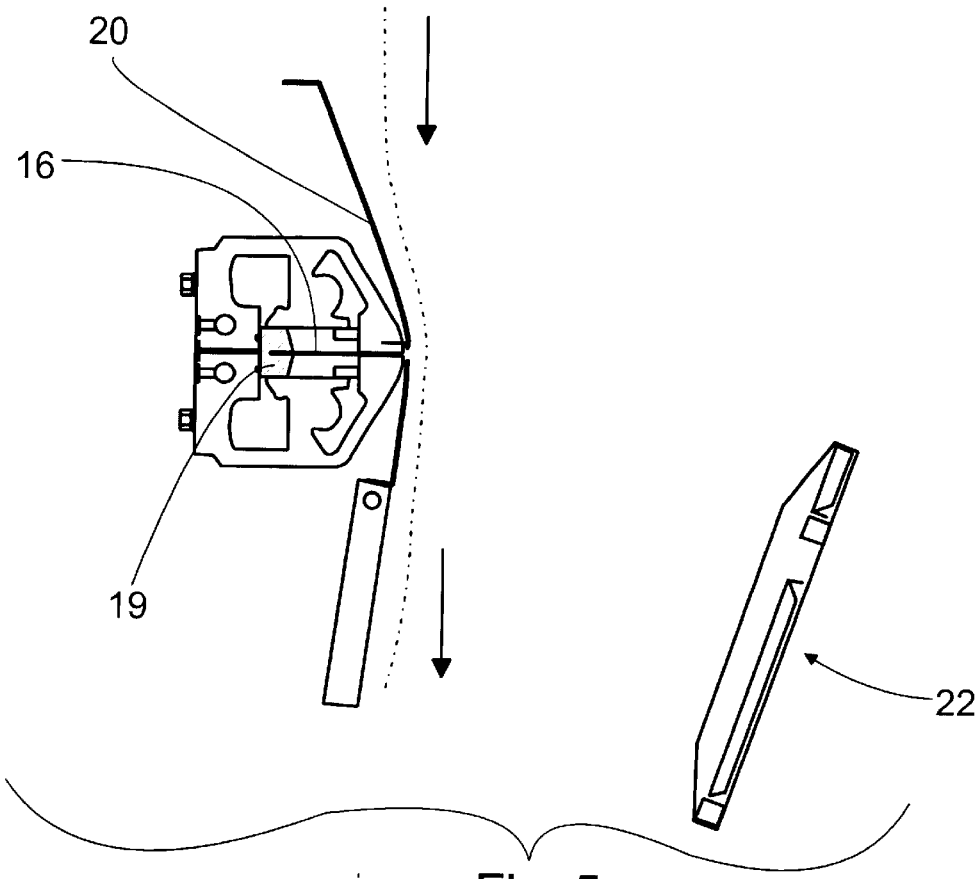
FIGS. 5*a*–6*b* show the stages of the operating principle of a cutting device according to the invention.
Figure 5B:
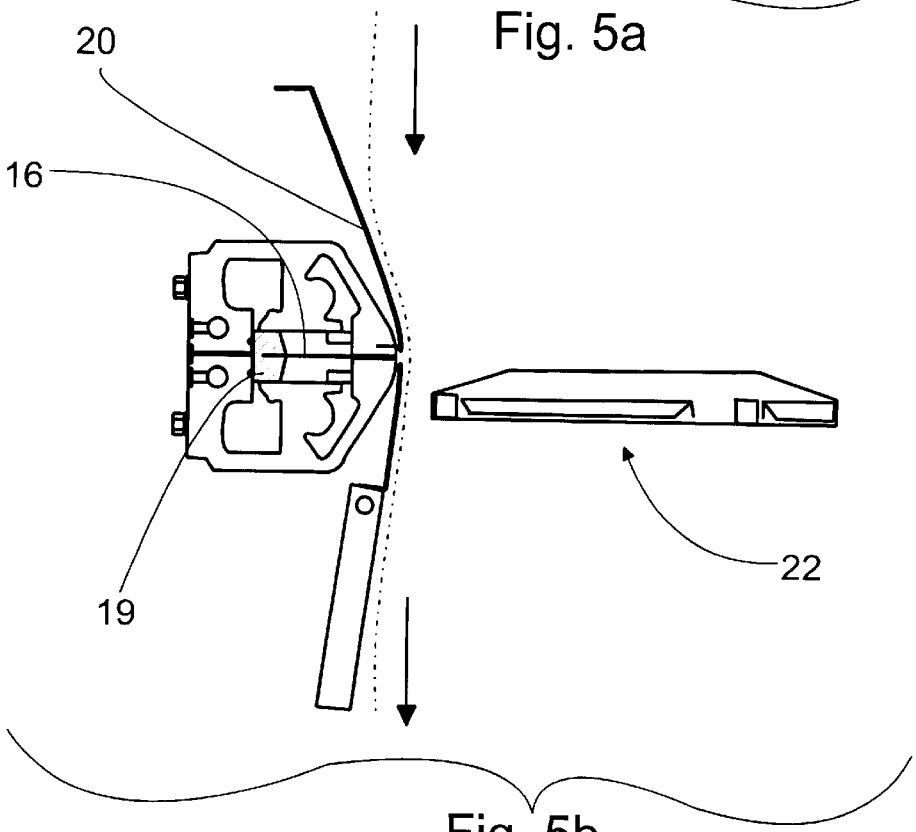

FIGS. 5*a*–6*b* show the operating principle of a cutting device according to the invention in stages. The tail is shown by a dotted line. The large arrows show the direction of movement of the tail and the small arrows the blasts of air. In the stage of FIG. 5*a*, the cutting device is in the operating position and the tail is being run down into the pulper. The tail may initially flutter a little, but the cutting device has no protrusions on which it can catch. Before cutting, the following feeding device, in this case guide plate 22, is set on the opposite side of the tail to the cutting device and essentially at the location of the blade. In addition, guide plate 22 is set essentially transversely in relation to the tail, because usually the tail is deflected considerably during cutting, generally by about 90°. The angle of deflection may be some other, within a wide range, as long as the tail deflects substantially. In connection with the turning of guide plate 22, the tail is run, with the aid of blower plat 20, against the cutting device and at the same time the tail is tension ed. FIG. 5*b* shows the situation before cutting.

Figure 6A:
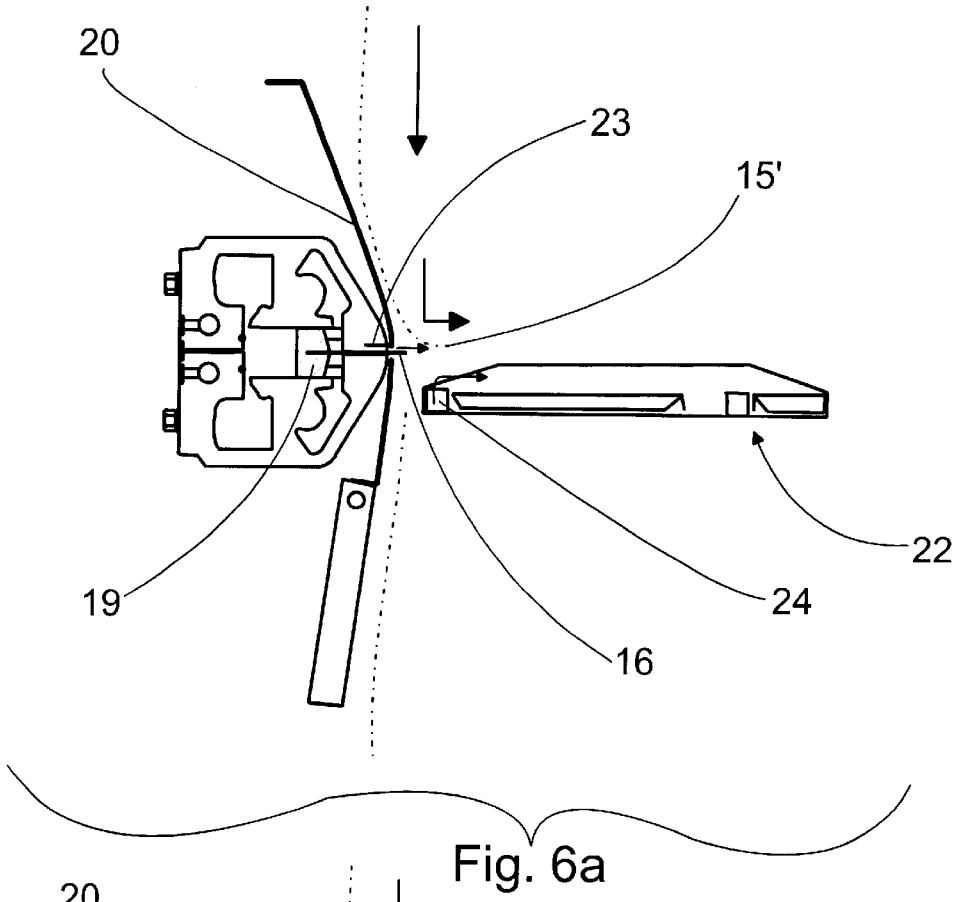
Figure 6B:
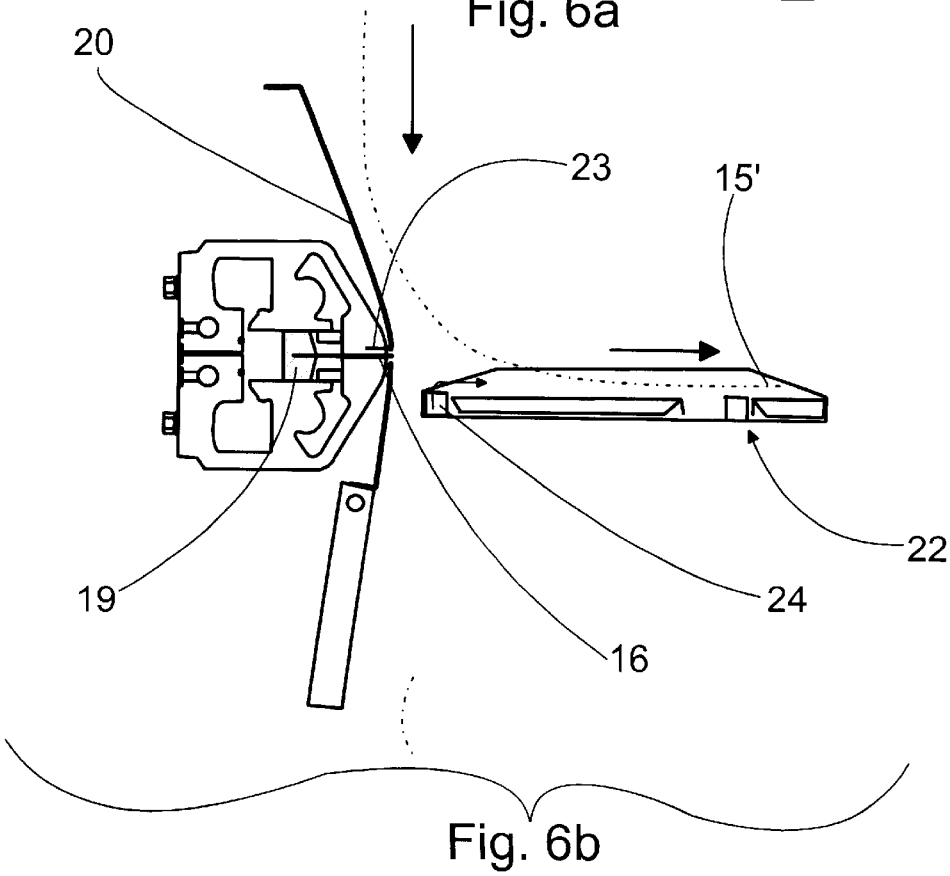

According to FIG. 6*a*, the tension ed tail is cut with a rapid impulse of blade 16 over the entire width of the tail. After cutting the tail, blade 16 is advantageously left at the end of its work stroke to form a guide protrusion to guide the cut end 15' to guide plate 22. In this case, during cutting, the cut end 15' of the tail is guided simply from the blade to guide plate 22. To ensure feeding, after the working stroke of blade 16, auxiliary blast 23 is used, directed from the cutting device in the desired direction. In FIG. 6*b*, the cut end 15' of tail 15 is led forwards to guide plate 22 by means of a blast that is created with the aid of a suitable nozzle 24.

The cutting device according to the invention is precise and fast. Thus, the tail is cut at the correct point at the correct moment. In addition, the result of the cut is even, which improves the guiding of the tail. The cutting device contains few components, which are simple to control and adjust. Thus, the cutting device can be automated easily. Besides the cutting device being suitable for all grades of paper, it can be applied in different places, thanks to its small and simple construction. The cutting point and time are also the same, irrespective of the grade of paper. In addition, the cutting device is safe, because the blade only protrudes for a short distance and there are no other structures opposite to it. Safety is increased by the fact that the blade's work stroke takes place in a gap between two plates.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A cutting device for a web feeding tail, which is intended to cut the web feeding tail and then to guide the cut web feeding tail in the desired direction, and which cutting device includes devices for detaching the web feeding tail from the roll, first web feeding devices for guiding the web feeding tail against the cutting device and for tensioning the web feeding tail for cutting, a blade connected to an operating device for cutting the web feeding tail with a single working stroke, without a counter-blade, and second web feeding devices for guiding the cut web feeding tail guided forwards, from the cutting device, in the desired direction, characterized in that the second web feeding device includes a guide plate, on the opposite side of the web feeding tail to which the cutting device is arranged, the guide plate is arranged to be moved essentially to the location of the blade at a distance from the web feeding tail, so that the web feeding tail is arranged to travel between the cutting device and the front of the guide plate, the aforesaid first web feeding devices are arranged to form a guide surface, against which the web feeding tail is arranged to be tension ed for cutting, an edge, which ends in the direction of travel of the web feeding tail, immediately after which the blade is located, and the work stroke path of the blade, which is arranged to operate in pulses, is arranged essentially according to the desired direction of the web feeding tail.

2. A cutting device according to claim 1, characterized in that, an auxiliary blast of air, which is essentially parallel to the guide plate is arranged before the blade.

3. A cutting device according to claim 1, characterized in that the guide plate is supported rotatably on an articulated joint, in such a way that the front of the guide plate is close to the cutting device.

4. A cutting device according to claim 1, in that, in the operating position, the distance of the front of the guide plate from the cutting device is 20–100 mm.

5. A cutting device according to claim 1, characterized in that the devices for detaching the web feeding tail from the roll, and the cutting device are arranged as a single entity, which is fitted rotatably in relation to bearer axles.

6. A cutting device according to claim 1, characterized in that the first web feeding devices include a blower plate, between the parts of which the blade is arranged to cut the web feeding tail.

7. A cutting device according to claim 6, characterized in that the part of the blower plate after the blade is supported on an articulated joint, so that the aforesaid part can be turned from the rest position into the operating position.

* * * * *